US005272869A

United States Patent [19]

Dawson et al.

[11] Patent Number: 5,272,869

[45] Date of Patent: Dec. 28, 1993

[54] TURBINE FRAME

[75] Inventors: John Dawson; Alan J. Charlton, both of Boxford, Mass.; Peter W. Mueller, Morrow, Ohio

[73] Assignee: General Electric Company, Cincinnati, Ohio

[21] Appl. No.: 988,623

[22] Filed: Dec. 10, 1992

[51] Int. Cl.[5] ..... F02C 7/20

[52] U.S. Cl. ..... 60/39.31; 415/142; 415/209.4

[58] Field of Search ..... 415/208.1, 209.2, 209.3, 415/209.4, 210.1, 134, 136, 137, 139, 142; 60/39.31, 39.32; 256/13.1; 403/187

[56] References Cited

U.S. PATENT DOCUMENTS

| | | | |
|---|---|---|---|
| 3,620,641 | 11/1971 | Keen et al. | 415/170 |
| 4,015,910 | 4/1977 | Harmon et al. | 415/209.2 |
| 4,197,702 | 4/1980 | Robertson | 60/262 |
| 4,378,961 | 4/1983 | Trousdell | 415/137 |
| 4,428,713 | 1/1984 | Coplin et al. | 415/48 |
| 4,722,184 | 2/1988 | Chaplin et al. | 60/226.1 |
| 4,793,770 | 12/1988 | Schonewald et al. | 415/190 |
| 4,965,994 | 10/1990 | Ciokajlo et al. | 60/39.75 |
| 4,987,736 | 1/1991 | Ciokajlo et al. | 60/39.31 |
| 5,076,049 | 12/1991 | Von Benken et al. | 60/39.31 |

OTHER PUBLICATIONS

I. E. Traeger, "Aircraft Gas Turbine Engine Technology," 1979, pp: i, ii, 493–499.

*Primary Examiner*—Richard A. Bertsch
*Assistant Examiner*—W. J. Wicker
*Attorney, Agent, or Firm*—Jerome C. Squillaro; Nathan D. Herkamp

[57] ABSTRACT

A turbine frame includes first and second coaxially disposed rings having a plurality of circumferentially spaced apart struts extending therebetween. A plurality of clevises join respective first ends of the struts to the first ring for removably joining the struts thereto. Each of the clevises includes a base removably fixedly joined to the first ring, and a pair of legs extending away from the base and spaced apart to define a U-shaped clevis slot receiving the strut first end. The strut first end is removably fixedly joined to the clevis legs by a pair of expansion bolts. The clevis base includes a central aperture aligned with a first port in the first ring for providing access therethrough.

7 Claims, 3 Drawing Sheets

TURBINE FRAME

The U.S. Government has rights in this invention in accordance with Contract No. N00019-92C-0149 awarded by the Department of the Navy.

CROSS REFERENCE TO RELATED APPLICATION

The present invention is related to concurrently filed patent application entitled "Turbine Frame" by R. Czachor et al, Ser. No. 07/988,637.

The present invention relates generally to gas turbine engines, and, more specifically, to frames therein for supporting bearings and shafts.

BACKGROUND OF THE INVENTION

Gas turbine engines include one or more rotor shafts supported by bearings which, in turn, are supported by annular frames. The frame includes an annular casing spaced radially outwardly from an annular hub, with a plurality of circumferentially spaced apart struts extending therebetween. The struts may be integrally formed with the casing and hub in a common casting, for example, or may be suitably bolted thereto. In either configuration, the overall frame must have suitable structural rigidity for supporting the rotor shaft to minimize deflections thereof during operation.

Furthermore, frames disposed downstream of the engine's combustor are, therefore, subject to the hot combustion gases which flow downstream from the combustor and through the engine's turbine which extracts energy therefrom for rotating the shaft. Since the struts extend radially inwardly from the casing, they necessarily pass through the combustion gases and must, therefore, be suitably protected from the heat thereof. Accordingly, conventional fairings typically surround the struts for providing a barrier against the hot combustion gases, and through which fairings cooling air may be channeled for preventing elevated temperatures of the frame.

Such a frame including fairings to protect against the combustion gases is typically referred to as a turbine frame, must, of course, be configured to allow the assembly thereof. In one conventional configuration, the casing, struts, and hub are an integral cast member, and, therefore, each of the fairings must be configured for assembly around each strut. For example, the fairing may be a sheetmetal structure having a radial splitline which allows the fairing to be elastically opened for assembly around a respective strut, the fairing then being suitably joined together at its splitline to complete the assembly.

In an alternate configuration, the struts may be integrally joined at one end to either the casing or the hub, and at its other end bolted to the complementary hub or casing. In this way, the fairing may be an integral hollow member which can be positioned over the free end of the strut prior to joining the strut free end to its respective casing or hub. In such an assembly, provisions must be provided to ensure that the joint between the strut end and the casing or hub provides suitable rigidity to ensure an overall rigid frame to suitably support the rotor shaft. In a typical conventional configuration wherein the strut outer end is bolted to the casing, the casing is an annular member having a plurality of radially extending generally inversely U-shaped slots which receive the strut ends. Conventional expansion bolts extend in generally tangential directions through the spaced apart radial legs defining the U-slot for rigidly joining the strut end to the casing. The expansion bolts provide zero clearance between where they pass through the strut end and the casing to ensure effective transmittal of both compression and tension loads between the strut and the casing.

However, the U-slots themselves provide circumferentially spaced apart discontinuities along the circumference of the casing which interrupt the hoop stress carrying capability of the casing and, therefore, decrease the overall rigidity of the frame. This reduction in rigidity may be minimized by making the strut outer end as small as possible in transverse configuration, with a practical limit being the transverse configuration of the central portion of the strut itself. This relatively small size of the strut outer end also ensures that the fairing surrounding the strut may be made as small as possible since it must be typically assembled over the strut outer end to complete the assembly of the turbine frame.

Accordingly, it is desirable to have a turbine frame having reduced-size struts for reducing the size of the fairing surrounding the strut while also rigidly mounting the strut to both the casing and the hub. In a configuration where the strut is bolted to either the casing or the hub, the joint therebetween should provide suitable rigidity to ensure the overall rigidity of the entire turbine frame for carrying both compression and tension loads through the struts without undesirable deflections of the hub which would affect the proper positioning of the rotor shaft supported thereby. Furthermore, it is also preferable to provide hollow struts to form a common channel through the casing and the hub for channeling air therethrough or for carrying service pipes such as lube oil or scavenge oil pipes into the engine sump located below the hub. This must be done without significantly reducing the overall structural rigidity of the turbine frame due to the required apertures, or interruptions, in either the casing or the hub for carrying the airflow or service pipes therethrough.

SUMMARY OF THE INVENTION

A turbine frame includes first and second coaxially disposed rings having a plurality of circumferentially spaced apart struts extending therebetween. A plurality of clevises join respective first ends of the struts to the first ring for removably joining the struts thereto. Each of the clevises includes a base removably fixedly joined to the first ring, and a pair of legs extending away from the base and spaced apart to define a U-shaped clevis slot receiving the strut first end. The strut first end is removably fixedly joined to the clevis legs by a pair of expansion bolts. The clevis base includes a central aperture aligned with a first port in the first ring for providing access therethrough.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
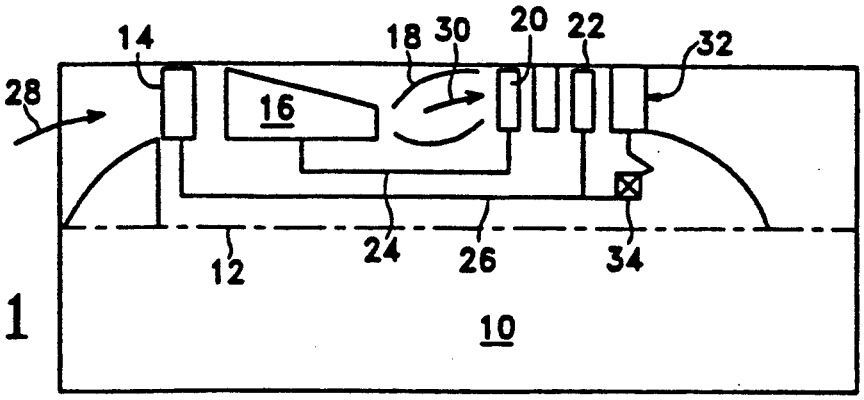
FIG. 1 is a schematic axial sectional view of a gas turbine engine having a turbine frame supporting a rotor shaft in accordance with one embodiment of the present invention.

Illustrated schematically in FIG. 1 is an exemplary gas turbine engine 10 having disposed about an axial or longitudinal centerline axis 12 in serial flow communication a fan 14, compressor 16, combustor 18, high pressure turbine (HPT) 20, and low pressure turbine (LPT) 22, all of which are conventional. A first shaft 24 joins the compressor 16 to the HPT 20, and a second shaft 26 joins the fan 14 to the LPT 22. During operation, air 28 enters the fan 14, a portion of which is compressed in the compressor 16 for flow to the combustor 18 wherein it is mixed with fuel and ignited for generating combustion gases 30 which flow downstream through the HPT 20 and the LPT 22 which extract energy therefrom for rotating the first and second shafts 24, 26.

An annular turbine frame 32 in accordance with one embodiment of the present invention is provided for supporting a conventional bearing 34 which, in turn, supports one end of the second shaft 26 for allowing rotation thereof. The turbine frame 32 is disposed downstream of the LPT 22 and, therefore, must be protected from the combustion gases 30 which flow therethrough.

Figure 2:
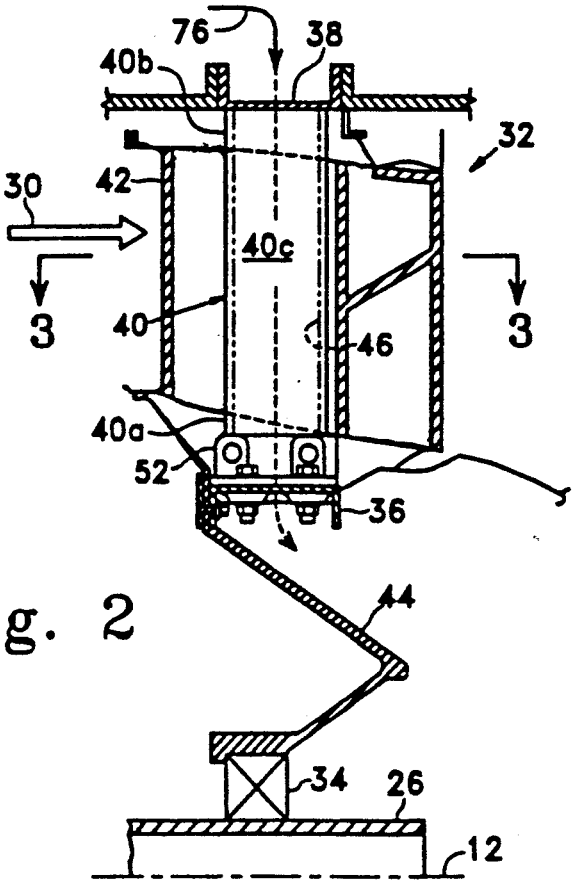
FIG. 2 is an enlarged axial, partly sectional view of the turbine frame illustrated in FIG. 1 showing an exemplary strut surrounded by a fairing.

The turbine frame 32 is illustrated in more particularity in FIG. 2 and includes a first structural ring 36, or hub for example, disposed coaxially about the centerline axis 12. The frame 32 also includes a second structural ring 38, or casing for example, disposed coaxially with the first ring 36 about the centerline axis 12 and spaced radially outwardly therefrom. A plurality of circumferentially spaced apart hollow struts 40 extend radially between the first and second rings 36 and 38 and are fixedly joined thereto.

The frame 32 also includes a plurality of conventional fairings 42 each of which conventionally surrounds a respective one of the struts 40 for protecting the struts from the combustion gases 30 which flow through the turbine frame 32. Conventionally joined to the hub 36 is a conventional, generally conical sump member 44 which supports the bearing 34 in its central bore.

Each of the struts 40 includes a first, or inner, end 40*a* and a radially opposite second, or outer, end 40*b*, with an elongate center portion 40*c* extending therebetween. As shown in FIG. 2 and additionally in FIG. 3, the strut 40 is hollow and includes a through channel 46 extending completely through the strut 40 from the inner end 40*a* and through the center portion 40*c* to the outer end 40*b*.

Figure 4:
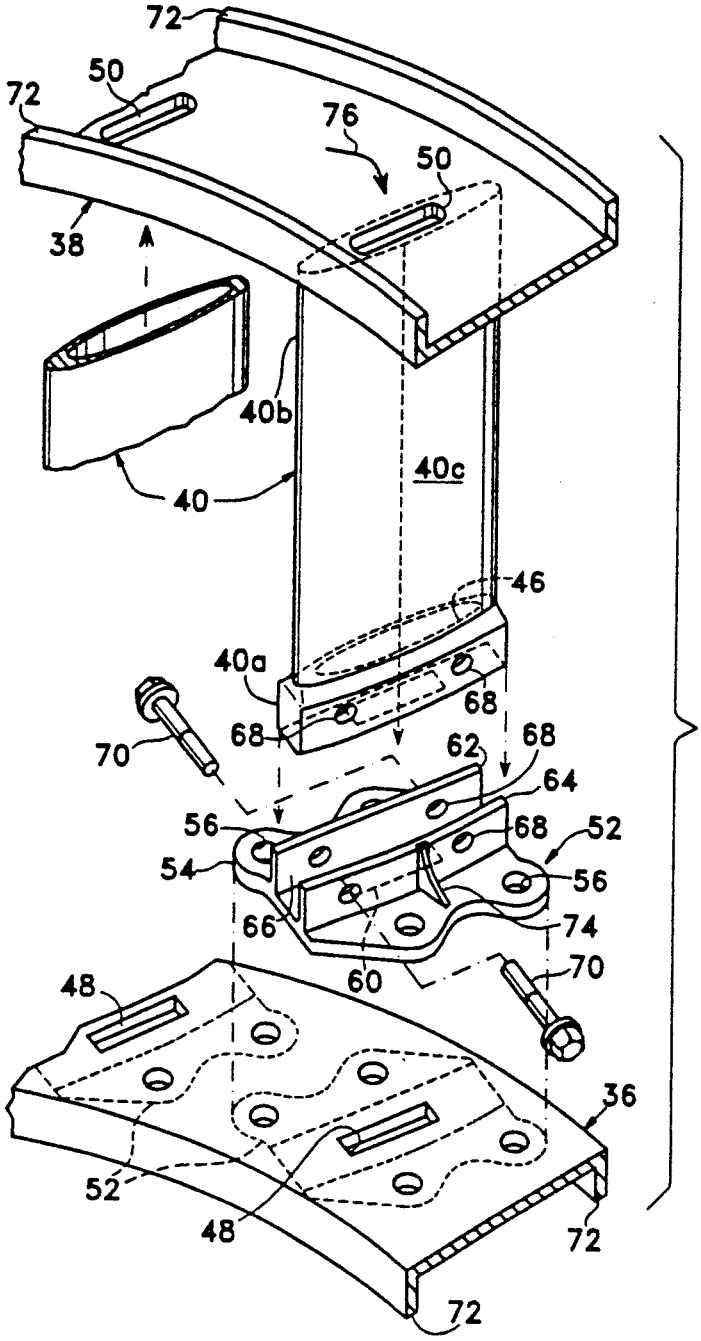
FIG. 4 is an exploded view of a portion of the turbine frame illustrated in FIG. 2 showing a strut extending from a casing and joined to a hub by a clevis in accordance with one embodiment of the present invention.

As shown in exploded view in FIG. 4, the hub 36 includes a plurality of circumferentially spaced apart first ports 48 extending radially therethrough, and the casing 38 similarly includes a plurality of circumferentially spaced apart second ports 50 extending radially therethrough.

In the exemplary embodiment illustrated in FIGS. 2 and 4, the outer ends 40*b* of the struts 40 are integrally formed with the casing 38 in a common casting, for example, and the inner ends 40*a* of the struts 40 are removably fixedly joined to the hub 36 in accordance with the present invention. In alternate embodiments, the strut inner ends 40*a* may be integrally joined to the hub 36 in a common casting, for example, with the strut outer ends 40*b* being removably joined to the casing 38 also in accordance with the present invention. In either configuration, the turbine frame 32 further includes a plurality of clevises 52 which removably join the strut inner ends 40*a* to the hub 36 in the configuration illustrated, or removably join the outer ends 40*b* to the casing 38 (not shown). In either configuration, each of the clevises 52 is disposed between a respective one of the strut ends 40*a*, 40*b* and the respective ring, i.e. hub 36 or casing 38, in alignment with respective ones of the first or second ports 48, 50 for removably joining the struts 40 to the first or second ring, i.e. hub 36 or casing 38, for both carrying loads and providing access therethrough.

Figure 5:
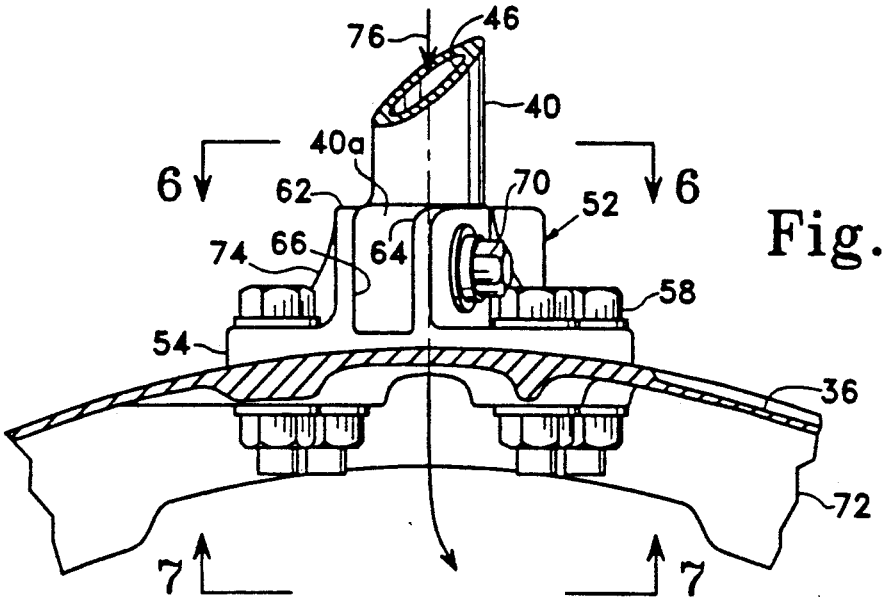
FIG. 5 illustrates in more particularity the strut inner end joined to the hub by the clevis shown in FIG. 2.

More specifically, and referring to FIGS. 4 and 5, each of the clevises 52 includes an arcuate base 54 disposed against the outer circumference of the hub 36, and includes a plurality of mounting holes 56, four being shown for example, for receiving a respective plurality of mounting bolts 58, with corresponding nuts, therethrough to removably fixedly join the base 54 to the hub 36. The base 54 includes a central aperture 60 aligned with a respective one of the first ports 48.

Referring again to FIGS. 4 and 5, the clevis 52 also includes first and second legs 62, 64 extending radially outwardly away from the base 54 and being preferably integral therewith, which legs 62, 64 are spaced circumferentially apart to define a generally axially extending U-shaped clevis slot 66 which receives the strut inner end 40*a*. The first and second legs 62, 64 and the strut inner end 40*a* have a pair of generally axially spaced apart line-drilled bores 68 extending therethrough which receive a respective pair of conventional expansion bolts 70 for removably fixedly joining the strut inner end 40*a* to the first and second legs 62, 64, with the strut through channel 46 being disposed generally axially between the two expansion bolts 70 and aligned with both the base aperture 60 and the first port 48 as shown in more particularly in FIGS. 6 and 8.

As shown in FIGS. 2 and 4, for example, the hub 36 includes a pair of axially spaced apart, annular stiffening ribs 72 disposed on opposite, axial sides of the clevises 52 and the first ports 48 for carrying loads between the struts 40 and the hub 36 without interruption by the first ports 48, for example. The casing 38 similarly includes a respective pair of stiffening ribs 72. The respective stiffening ribs 72 are continuous and uninterrupted annular members which carry loads in the hoop-stress direction without interruption by either the ports 48, 50 or the struts 40 joined to the respective hub 36 and casing 38. In this way, loads may be transmitted from the hub 36 through the clevises 52 and through the struts 40 to the casing 38, with the stiffening ribs 72 ensuring substantially rigid annular members to which the struts 40 are connected. In the exemplary embodiment illustrated in FIGS. 2 and 4, the strut outer end **40*b* is integrally formed with the casing 38, whereas the strut inner end 40*a* is joined to the hub 36 using the clevis 52. The clevis base 54 is rigidly mounted to the hub 36 by the four mounting bolts 58, and the strut inner end 40*a* is rigidly mounted to the first and second legs 62, 64 by the expansion bolt pair 70**.

As shown in FIGS. 4–6 and 8, the clevis 52 preferably also includes a plurality of gussets 74 integrally joining the clevis first and second legs 62, 64 to the clevis base 54 for carrying bending loads transmitted through the strut 40 and the hub 36. These gussets 74 improve the rigidity of the clevis 52 while minimizing the weight thereof and allow the strut inner end **40*a* to be made as small as possible for minimizing the size of the fairing 42**.

Figure 3:
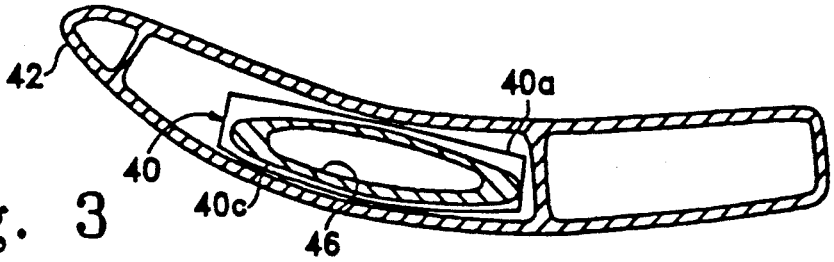
FIG. 3 is a transverse sectional view through the strut and fairing illustrated in FIG. 2 and taken along line 3—3.

More specifically, and referring firstly to FIG. 4, the strut inner end **40*a* is sized substantially equal in transverse section with the strut center portion 40*c*, although they have generally different configurations, for allowing the strut inner end 40*a* to fit through a respective one of the fairings 42 during assembly as shown in FIG. 3. In this exemplary embodiment, the fairing 42 is a one-piece cast hollow member which may be assembled with the strut 40 solely by being radially positioned upwardly over the strut inner end 40*a* and into position around the strut center portion 40*c*. As shown in FIG. 3, the strut inner end 40*a* is generally rectangular and about the same size as the strut center portion 40*c*, which is generally airfoil-shaped, to fit through the fairing 42 with minimum clearance therewith for maintaining a relatively small size of the fairing 42**.

Figure 8:
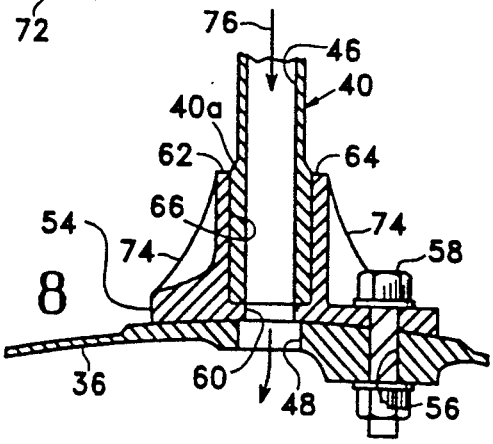
FIG. 8 is a radial sectional view of the strut inner end joined to the hub by the clevis in FIG. 6 and taken along line 8—8.
Figure 6:
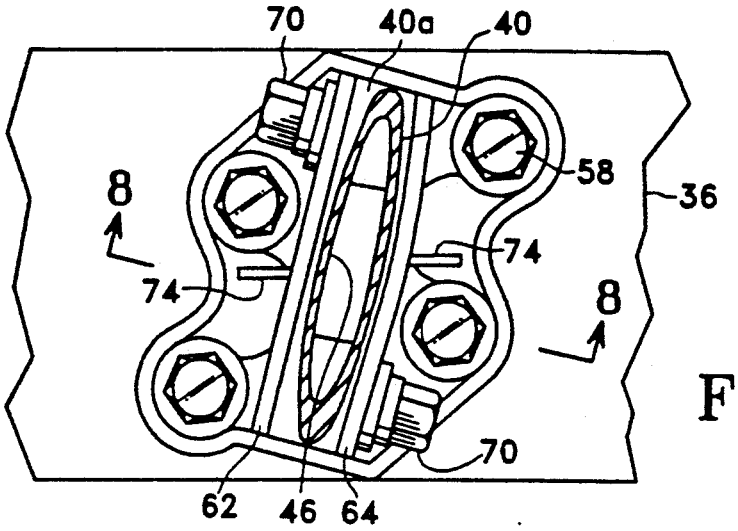
FIG. 6 is a top, partly sectional view of the strut inner end and the clevis illustrated in FIG. 5 and taken along line 6—6.

In view of this relatively small size of the strut inner end **40*a*, the clevis first and second legs 62, 64 are reinforced with the gussets 74 to increase the rigidity between the strut inner end 40*a* when it is joined into the clevis 52. As shown in FIG. 8, the strut inner end 40*a* is preferably disposed in the clevis slot 66 in abutting contact with the top of the clevis base 54 for carrying compressive loads directly thereto through the strut 40 during operation. The expansion bolts 70 as shown in FIGS. 5 and 6, for example, carry tensile loads through the struts 40 between the hub 36 and the casing 38, with compressive loads being carried primarily through direct contact between the strut inner end 40*a* and the clevis base 54, although compressive loads may also be carried through the expansion bolts 70 as well. In this way, effective load transfer from the hub 36 and through the struts 40 into the casing 38 is effected for improving the overall rigidity of the turbine frame 32**.

Figure 7:
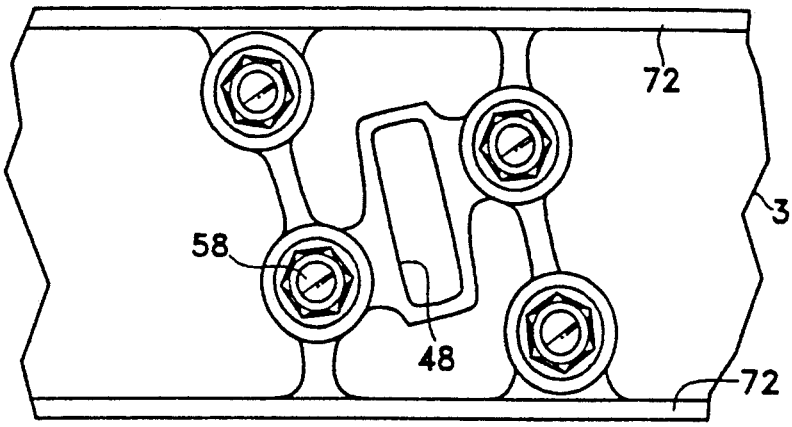
FIG. 7 is an upward view of the hub below the clevis illustrated in FIG. 5 and taken along line 7—7.

Referring again to FIGS. 5, 7, and 8, the strut inner end **40*a* is also disposed in the clevis slot 66 in sealing arrangement with the first port 48 through the central aperture 60 for channeling airflow through the ports 48 and 50 of the hub 36 and casing 38. In the exemplary embodiment illustrated in FIGS. 2 and 4, for example, cooling air 76 is allowed to flow through the casing second ports 50 and downwardly through the struts 40, and in turn through the central apertures 60 of the clevises 52 and through the hub first ports 48 for conventional use inside the engine. By configuring the strut inner end 40*a* to contact the top of the clevis base 54 around the entire perimeter of the channel 46 as shown in FIG. 8, an effective seal is provided between the strut inner end 40*a* and the clevis 52 for ensuring flow of the cooling air 76 therethrough, while also allowing compressive loads to be channeled from the hub 36 and through the clevis base 54 directly to the strut inner ends 40*a***.

Although in this exemplary embodiment, the strut channel 46 is provided for directly channeling the cooling air 76 therethrough, in alternate embodiments, conventional service pipes carrying oil, for example, may be routed through the hub 36, casing 38, and corresponding struts 40 for channeling oil to and from the region of the sump 44.

The resulting turbine frame 32 provides substantial overall rigidity even through the strut inner ends **40*a* are removably joined to the hub 36 using the respective clevises 52, while also providing access through the individual struts 40 for the cooling air 76 or the conventional service pipes. The turbine frame 32 allows an improved method of manufacture wherein the individual clevises 52 may firstly be temporarily joined to the strut inner ends 40*a* for allowing the bores 68 to be line-drilled therethrough for providing continuous and pre-aligned bores 68 for receiving the respective expansion bolts 70. The inner surface of the pre-assembled clevises 52 may then be conventionally ground to a suitable arc for mating with the outer diameter of the hub 36. The clevises 52 may then be located in position on the hub 36 so that the mounting holes 56 may be line-drilled to extend also through the hub 36 for providing effective alignment of the clevis 52 therewith for receiving the mounting bolts 58**.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A turbine frame comprising:

a first ring disposed coaxially about an axial centerline axis and having a plurality of circumferentially spaced apart first ports;

a second ring disposed coaxially with said first ring and spaced radially therefrom, and having a plurality of circumferentially spaced apart second ports;

a plurality of circumferentially spaced apart struts joined radially between said first and second rings, each strut having radially opposite first and second ends, and a through channel extending therebetween; and a plurality of clevises, each of said clevises being disposed between a respective one of said strut first ends and said first ring in alignment with a respective one of said first ports for removably joining said struts to said first ring for both carrying loads and providing access therethrough;

each of said clevises comprising:

a base disposed against said first ring and having a plurality of mounting holes receiving mounting bolts therethrough to removably fixedly join said base to said first ring, said base having a central aperture aligned with said first port; and first and second legs extending away from said base and spaced circumferentially apart to define a U-shaped clevis slot receiving said strut first end; said first and second legs and said strut first end having a pair of spaced apart bores extending therethrough and receiving a respective pair of expansion bolts for removably fixedly joining said strut first end to said first and second legs, with said strut through channel being disposed between said expansion bolt pair and aligned with both said base aperture and said first port.

2. A frame according to claim 1 wherein said first ring includes a pair of axially spaced apart annular stiffening ribs disposed on opposite sides of said clevises and said first ports for carrying loads between said struts and said first ring.

3. A frame according to claim 2 wherein said clevis further comprises a plurality of gussets joining said clevis first and second legs to said clevis base for carrying bending loads transmitted through said strut and said first ring.

4. A frame according to claim 3 wherein said strut first end is disposed in said clevis slot in sealing arrangement with said first port for channeling airflow through said first and second rings and said struts.

5. A frame according to claim 3 wherein said strut first end is disposed in said clevis slot in abutting contact with said clevis base for carrying compressive loads directly thereto through said strut.

6. A frame according to claim 5 wherein:

said first ring is in the form of a hub disposed radially inwardly of said struts;

said second ring is in the form of a casing disposed radially outwardly of said struts; and said clevises removably join radially inner ends of said struts to said hub.

7. A frame according to claim 6 further comprising a plurality of fairings, each fairing surrounding a respective one of said struts; and wherein each of said struts includes a center portion, with said strut first end being sized substantially equal in transverse section with said strut center portion for fitting through a respective one of said fairings.

* * * * *